United States Patent [19]

Hennecke et al.

[11] 4,096,916

[45] Jun. 27, 1978

[54] DIESEL PILE DRIVER

[75] Inventors: Rudolf Hennecke, Buoch; Albert Haussmann, Oberboihingen, both of Germany

[73] Assignee: Delmag-Maschinenfabrik Reinhold Dornfeld, Esslingen am Neckar, Germany

[21] Appl. No.: 553,573

[22] Filed: Feb. 27, 1975

[30] Foreign Application Priority Data

Mar. 13, 1974 Germany ..... 2412036

[51] Int. Cl.[2] ..... E02D 7/12

[52] U.S. Cl. ..... 173/137; 123/46 H

[58] Field of Search ..... 173/137, 128; 123/465 C, 46 H

[56] References Cited

U.S. PATENT DOCUMENTS

| | | | |
|---|---|---|---|
| 2,804,856 | 9/1957 | Spurlin | 173/135 X |
| 3,679,005 | 7/1972 | Inaba et al. | 173/137 X |
| 3,747,693 | 7/1973 | Kümmel et al. | 173/137 X |

*Primary Examiner*—Ernest R. Purser
*Assistant Examiner*—William F. Pate, III
*Attorney, Agent, or Firm*—Olsen and Stephenson

[57] ABSTRACT

A diesel pile driver with impact atomization of the fuel between pile driver piston and an impact member as well as with a fuel injection pump and an injector nozzle, which sprays fuel onto the impact member in the pile driver cylinder.

4 Claims, 5 Drawing Figures

DIESEL PILE DRIVER

Figure 1:
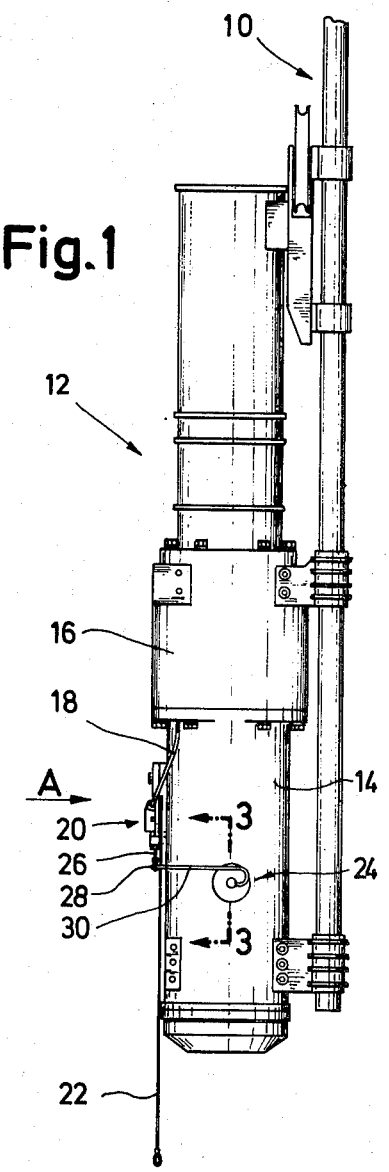

The invention relates to a diesel pile driver with impact atomisation of the fuel between a pile driver piston and an impact member as well as with a fuel injection pump and an injection nozzle, spraying the fuel onto the impact member, in the wall of the pile driver cylinder.

In Diesel pile drivers of this kind, in which the pile driver piston falling down upon the impact member atomises the fuel, the quantity of fuel applied in liquid form for each working cycle of the pile driver on to the impact surface of the impact member co-operating with the pile driver piston should remain as completely as possible on this impact surface until the pile driver piston impinges upon the impact member. This is now not the case in the known Diesel pile drivers of the initially mentioned kind, since the fuel sprayed obliquely from above upon the impact surface by the injection nozzle disposed high above this impact surface of the impact member in part also sprays away over the entire impact surface up to the region of the wall of the pile driver cylinder. Fuel, which has arrived on this wall, can however no longer be atomized by the impact surface of the pile driver piston. It is further to be observed, that impact member and pile driver piston, when this rests upon the impact member, are surrounded by an annular space formed by a groove of the impact member surrounding the impact surface and a tapering of the pile driver piston in the direction towards its impact surface. This annular space is required, since during the impinging of the pile driver piston upon the impact member, the fuel is impact-atomized into this space. When now in the case of the known Diesel pile drivers of the initially mentioned kind, the fuel jet injected by an injection nozzle necessarily impinges obliquely from above upon the impact surface of the impact member, then a part of the fuel due to its appreciable kinetic energy originating from the injection process runs away beyond the impact surface up to the groove surrounding the latter; this proportion of the injected fuel can also not be impact-atomized. Unatomized fuel however contributes hardly anything to the work output of the Diesel pile driver and it burns slowly and with formation of smoke, which in view of the present endeavours toward the creation of environmentally friendly working machines is to be regarded as extraordinarily disadvantageous.

The invention was now based upon the task of so improving Diesel pile drivers of the initially mentioned kind, that the injected fuel is more completely atomized. This problem lets itself be solved in accordance with the invention thereby, that at least one pair of injection nozzles, disposed opposite one another in the wall of the pile driver piston, is provided in a manner in itself known. Thereby, it is attained, that the two streams of fuel originating from the injection nozzle of one pair impinge upon one another on the impact surface of the impact member and mutually brake themselves, so that practically no part of the fuel injected for each working cycle can in the space of time between the injection process and the impinging of the pile driver piston upon the impact member flow away over the entire impact surface thereof as far as into the groove surrounding this or spray up to the wall of the pile driver cylinder. In the case of a Diesel pile driver according to the invention, one manages by comparison with known constructions of the initially mentioned kind with a substantially smaller quantity of fuel for each working cycle of the pile driver to generate the same ramming performance, the fuel consumption namely letting itself be reduced by up to 35%. Simultaneously, the smoke and soot formation is however also reduced and the operating temperatures of the Diesel pile driver let themselves be lowered due to the smaller consumption of fuel, which is an appreciable advantage particularly in the hot season of the year.

Although Diesel pile drivers with two injection nozzles disposed opposite one another in the wall of the pile driver cylinder are known (DT-PS 975 722), this known construction however concerns a pile driver, in which the fuel is atomized already during injection by the injection nozzle, that is to say not a pile driver with impact atomisation of the fuel. In this known pile driver, the fuel is also injected into an annular space, which surrounds the impact member but which is however formed exclusively by the impact member, which in the centre possesses a stub-like projection, against which the pile driver piston strikes. This known construction could now not suggest the invention not only because it concerns a Diesel pile driver of another category, namely not a pile driver with impact atomisation of the fuel, but it could also not inspire any kind of consideration in that direction for the reason, that one lets two fuel jets, injected by two injection nozzles disposed opposite one another, impinge upon one another, since the stub-shaped projection of the impact member in this known pile driver is raised beyond the plane of the two injection nozzles disposed opposite one another, so that it would prevent the impinging upon one aother of two fuel jets.

In a preferred embodiment of the pile driver according to the invention, in which the injection pump is actuable directly by the pile driver piston, the injection nozzles provided with injection valves are arranged at a spacing from the injection pump underneath this. In such a pile driver, the injected fuel is atomized still more completely than this would be the case in a Diesel pile driver, in which the injection nozzles lie in the usual manner approximately in the level of the injection pump, since the danger is then avoided, that fuel at the end of the injection process is sprayed upon the envelope of the downwardly falling pile driver piston and is thus withdrawn from the impact atomisation process. Moreover, the lower disposition of the injection nozzles has the advantage, that the fuel jets more flatly impinge upon the impact surface of the impact member, from which in connection with the impinging upon one another of the fuel jets a better flooding of the impact surface results.

The optimum arrangement of the injection nozzles is that, in which the injection angle relative to the axis of the pile driver cylinder amounts to approximately 20°, since with too flat an impingement of the fuel jets upon the impact surface, the danger of a kind of reflection exists and because fuel jets impinging too steeply upon the impact surface have the consequence of a bad distribution of the fuel over the impact surface.

Trials have also shown, that a particularly good scavenging of the combustion chamber results in the case of Diesel pile drivers according to the invention with only one pair of injection nozzles and at least one exhaust opening in the pile driver cylinder, when the exhaust opening or all exhaust openings, respectively, lies or lie on one side of that axial plane of the pile driver cylinder, which extends through the injection nozzles (by an axial plane is to be understood a plane extending through the longitudinal central axis of the pile driver cylinder). It is to be remarked in this context, that Diesel pile drivers with several exhaust openings are known.

Figure 2:
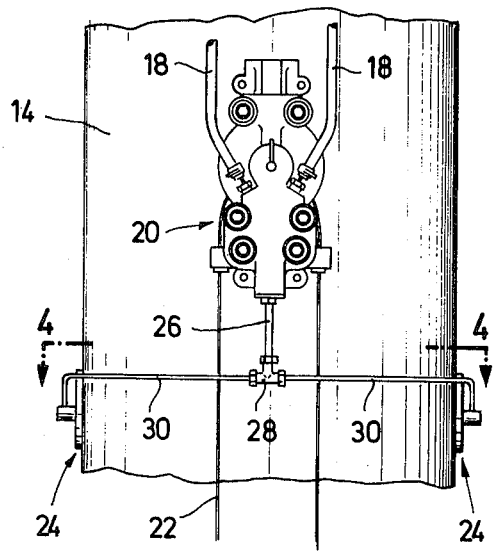
Figure 3:
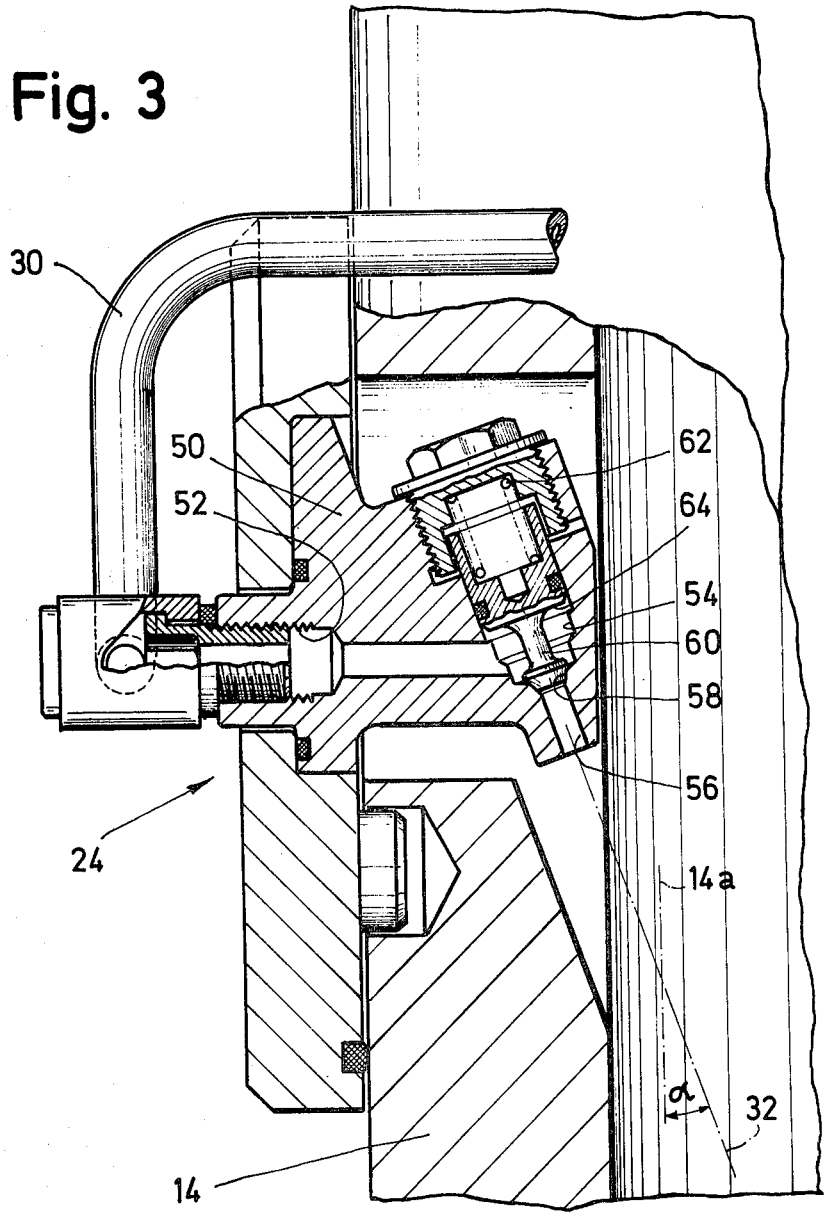
Figure 4:
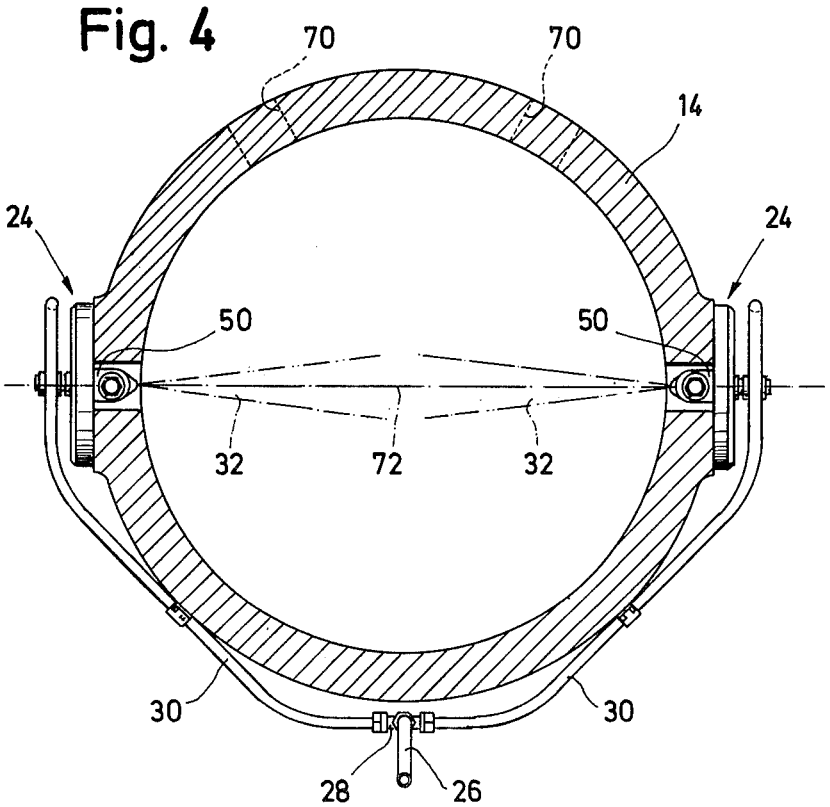
Figure 5:
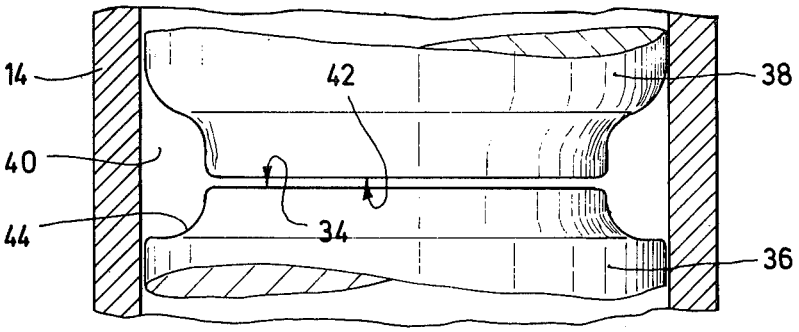

Further features and details of the invention are evident from the attached diagrammatic illustration and the following description of a preferred embodiment of the invention; there show:

FIG. 1 in side elevation, a Diesel pile driver guided along a guide,

FIG. 2 a side elevation of a part of the pile driver cylinder with injection pump and injection nozzles according to arrow A in FIG. 1, FIG. 3 a section through one of the injection nozzles according to the line 3—3 in FIG. 1, FIG. 4 a section through the pile driver cylinder according to the line 4—4 in FIG. 2, and FIG. 5 parts of the pile driver piston and the impact member with the pile driver cylinder opened up.

A Diesel pile driver designated in its entirety by 12 is guided on a guide 10 formed as a tubular scaffold. Its pile driver cylinder 14 is surrounded by a tank 16 having the shape of an annular envelope, to which a fuel injection pump is connected by ducts 18. This sits on the pile driver cylinder and for example displays a not shown lever, which protrudes through a slot in the pile driver cylinder into the path of the pile driver piston and is swivelled by the downwardly falling piston. Thereby, the injection pump is actuated. A control rope 22 serves the setting of the quantity of fuel injected for each working cycle.

The features mentioned so far of the Diesel pile driver according to the invention are known and familiar to every expert, so that a more detailed description and diagrammatic illustration is redundant.

Two injection nozzles designated in entirety by 24 are now mounted in the wall of the pile driver cylinder 14, namely in accordance with the invention at a spacing underneath the injection pump 20 and disposed diametrally opposite one another. They are connected with the outlet of the injection pump 20 by a fuel duct 26, a distributor member 28 and fuel ducts 30.

FIG. 4 allows to be recognised particularly clearly, that two jets 32 of liquid fuel injected by these injection nozzles into the interior of the pile driver cylinder impinge upon one another approximately in the centre of the pile driver cylinder, so that the kinetic energy of the fuel is destroyed and care is taken, that the fuel applied by the two injection nozzles onto the impact surface 34 of an impact member 36 mounted in known manner in the pile driver cylinder 14 remains upon this impact surface in the short space of time, which elapses between the injection process and the impinging of the pile driver piston 38 upon the impact member 36. It here remains to be added, that the two injection nozzles 24 do not absolutely have to spray obliquely at the same angle downwardly from above the impact surface 34 and that it is also not required, that the two fuel jets 32 are directed to the centre of the impact surface 34. Essential is only that the two currents of fuel are directed against one another on the impact surface 34 of the impact member 36 and impinge upon one another.

It is particularly expedient, when the fuel jets 32 form an angle $\alpha$ of about 20° with the axis of the pile driver cylinder or with a line 14*a* parallel thereto.

FIG. 5 also lets clearly be recognised the annular space 40, which surrounds the impact surfaces 34 and 42 of the impact member 36 and the pile driver piston 38 and which is formed thereby, that the impact surface 34 of the impact member is surrounded by a groove 44 and that the pile driver piston 38 tapers down in the direction towards its impact surface 42.

The construction of the injection nozzles 24 can be deduced from FIG. 3: A housing 50 inserted in the wall of the pile driver cylinder 14 displays an inlet bore 52 and a stepped bore 54; the inlet bore is connected to one of the fuel ducts 30. The stepped bore 54 forms an outlet opening 56 for the fuel as well as a valve seating 58 for a valve member 60, which under the effect of a helical spring 62 normally keeps closed the injection valve formed by the valve seating and the valve member. Should however a pressure build up in the inlet bore 52 during the conveying stroke of the injection pump 20, then the valve member 60 opens due to the pressure exerted upon its end face 64, so that a jet of liquid fuel leaves the outlet opening 56. When the pressure in the inlet bore 52 drops at the end of the conveying stroke of the injection pump 20, the injection valve 58 and 60 again closes.

As is indicated in FIG. 4, two exhaust openings 70 lie above the plane of the injection nozzles 24, both exhaust openings namely being arranged on one side of that axial plane 72, which extends through the two injection nozzles 24. Trials have shown, that a particularly favourable scavenging of the combustion space results thereby, namely above all in such Diesel pile drivers, in which the exhaust opening or the exhaust openings is or are still open during at least a part of the injection process, that is not yet overrun by the pile driver piston 38 and closed by this.

The invention proves itself to be especially advantageous in an application to Diesel pile drivers, the impact surfaces of which are formed to be planar, since there the danger is of course particularly great, that the injected fuel flows or sprays away beyond the impact member. The invention is thus particularly advantageous in its application to Diesel pile drivers of the kind claimed and described in the U.S. Pat. No. 3,747,693.

We claim:

1. A diesel pile driver comprising a pile driver cylinder, a pile driver piston mounted in said cylinder and having an impact surface, an impact member mounted in said cylinder adjacent to said piston and having an impact surface facing the impact surface of said piston, a pair of liquid jet injection nozzles mounted in the wall defining said cylinder for injecting liquid fuel onto the impact surface of said impact member, said nozzles being operable to discharge the liquid fuel onto the impact surface when the piston is descending from an elevated position for subsequent impact atomization of the fuel induced by the piston engaging the impact member, said nozzles being positioned to discharge jets of liquid fuel that impinge upon one another on the impact surface of the impact member so as to destroy substantially the kinetic energy of flow of the liquid fuel, and a fuel injection pump for delivering fuel to said nozzles as an incident to the descending movement of the piston at said elevated position.

2. The diesel pile driver that is defined in claim 1, wherein said injection pump is actuable directly by movement of the pile driver piston as it advances toward said impact member, and said injection nozzles include injection valves responsive to the pump pressure to open, said injection valves being located axially between the impact member and the location where said piston actuates said injection pump.

3. The diesel pile driver that is defined in claim 1, wherein the injection angle of the injection nozzles relative to the axis of the pile driver cylinder is approximately 20°.

4. The diesel pile driver that is defined in claim 1, wherein said injection nozzles are diametrally located relative to the pile driver cylinder, and said pile driver cylinder has at least one exhaust opening, each said exhaust opening being located on only one side of an axial plane of the pile driver cylinder which extends through the pair of injection nozzles.

* * * * *